US007517172B2

(12) United States Patent
Sipaila

(10) Patent No.: US 7,517,172 B2
(45) Date of Patent: Apr. 14, 2009

(54) SUBSURFACE FLUID DISTRIBUTION APPARATUS

(75) Inventor: Jonas Z. Sipaila, Reno, NV (US)

(73) Assignee: Rehbein Environmental Solutions, Inc., Minneapolis, MN (US)

( * ) Notice: Subject to any disclaimer, the term of this patent is extended or adjusted under 35 U.S.C. 154(b) by 0 days.

(21) Appl. No.: 12/058,528

(22) Filed: Mar. 28, 2008

(65) Prior Publication Data

US 2008/0240859 A1 Oct. 2, 2008

Related U.S. Application Data

(60) Provisional application No. 60/908,933, filed on Mar. 29, 2007.

(51) Int. Cl.
*E02B 11/00* (2006.01)

(52) U.S. Cl. ..... 405/45; 405/36; 405/43; 405/46; 405/49

(58) Field of Classification Search ..... 405/36, 405/43, 45, 46, 49
See application file for complete search history.

(56) References Cited

U.S. PATENT DOCUMENTS

| | | | | | |
|---|---|---|---|---|---|
| 980,442 | A * | 1/1911 | Schlafly | 405/48 |
| 1,608,889 | A * | 11/1926 | Lampe | 405/48 |
| 2,240,411 | A * | 4/1941 | Newman | 405/47 |
| 3,220,194 | A * | 11/1965 | Lienard | 405/45 |
| 4,245,924 | A * | 1/1981 | Fouss et al. | 405/45 |
| 4,360,042 | A * | 11/1982 | Fouss et al. | 138/119 |
| 4,759,661 | A * | 7/1988 | Nichols et al. | 405/48 |
| 5,017,041 | A * | 5/1991 | Nichols | 405/48 |
| 5,087,151 | A * | 2/1992 | DiTullio | 405/43 |
| 5,156,488 | A * | 10/1992 | Nichols | 405/48 |
| 5,336,017 | A * | 8/1994 | Nichols | 405/46 |
| 5,399,050 | A * | 3/1995 | Jacobus | 405/229 |
| 5,401,116 | A * | 3/1995 | Nichols | 405/48 |
| 5,511,903 | A * | 4/1996 | Nichols et al. | 405/43 |
| 5,588,778 | A * | 12/1996 | Nichols et al. | 405/48 |
| 5,669,733 | A * | 9/1997 | Daly et al. | 405/48 |
| D403,047 | S * | 12/1998 | Gray | D23/207 |
| 5,921,711 | A * | 7/1999 | Sipaila | 405/45 |
| 6,076,993 | A * | 6/2000 | Gray | 405/43 |
| 6,270,287 | B1 * | 8/2001 | Gray | 405/100 |
| 6,361,248 | B1 | 3/2002 | Maestro | |
| 6,375,388 | B1 * | 4/2002 | Zoeller et al. | 405/43 |
| D477,381 | S * | 7/2003 | Benecke | D23/207 |
| 6,592,293 | B1 * | 7/2003 | Hedstrom et al. | 405/48 |
| 6,698,975 | B1 * | 3/2004 | Benecke | 405/43 |
| 6,719,490 | B2 | 4/2004 | Maestro | |
| 6,854,925 | B2 * | 2/2005 | DiTullio | 405/49 |
| 6,994,355 | B2 * | 2/2006 | Brochu et al. | 277/606 |

(Continued)

*Primary Examiner*—Sunil Singh
(74) *Attorney, Agent, or Firm*—John C. Lambertsen; Kenehan & Lambertsen, Ltd.

(57) ABSTRACT

A leaching chamber having an arch-shaped cross-section, a pair of contiguously molded, opposing end walls, and alternating peak and valley corrugations along its length, is provided interior chambers and fluid communication openings along the base on each extending side of the chamber. Formed within the chamber at locations corresponding to each peak corrugation, an inner wall is attached to an interior surface and extends substantially within the peak corrugation to the base of the chamber. An aperture is formed in both the inner wall and in the opposing outer wall of the chamber, enabling fluid communication through the interior chamber—and thus into and out from the interior of the leaching chamber itself.

20 Claims, 4 Drawing Sheets

U.S. PATENT DOCUMENTS

| | | | | |
|---|---|---|---|---|
| 7,052,209 | B1 * | 5/2006 | Kruger et al. | 405/125 |
| 7,118,306 | B2 * | 10/2006 | Kruger et al. | 405/49 |
| 7,134,808 | B2 * | 11/2006 | Albone et al. | 405/126 |
| D538,388 | S * | 3/2007 | Benecke | D23/207 |
| D538,882 | S * | 3/2007 | Benecke | D23/207 |
| 7,189,027 | B2 * | 3/2007 | Brochu et al. | 405/43 |
| 7,237,981 | B1 * | 7/2007 | Vitarelli | 405/42 |
| 7,273,330 | B1 * | 9/2007 | Brochu et al. | 405/43 |
| 7,364,384 | B1 * | 4/2008 | Swistak | 405/46 |
| 2002/0025226 | A1 | 2/2002 | Maestro | |
| 2002/0139736 | A1 * | 10/2002 | Stever et al. | 210/170 |
| 2003/0219310 | A1 * | 11/2003 | Burnes et al. | 405/39 |
| 2004/0013469 | A1 * | 1/2004 | Hedstrom et al. | 405/48 |
| 2004/0042855 | A1 * | 3/2004 | Benecke | 405/43 |
| 2004/0101369 | A1 * | 5/2004 | DiTullio | 405/49 |
| 2005/0074287 | A1 * | 4/2005 | Brochu et al. | 405/43 |
| 2005/0074288 | A1 * | 4/2005 | Moore, Jr. | 405/46 |
| 2005/0111915 | A1 * | 5/2005 | Moore et al. | 405/46 |
| 2005/0238434 | A1 * | 10/2005 | Coppes et al. | 405/49 |
| 2007/0154261 | A1 * | 7/2007 | Brochu et al. | 405/43 |
| 2007/0172314 | A1 * | 7/2007 | Brochu et al. | 405/43 |

* cited by examiner

SUBSURFACE FLUID DISTRIBUTION APPARATUS

CROSS-REFERENCE TO RELATED APPLICATION

This application claims the benefit of U.S. Provisional Patent Application Ser. No. 60/908,933, filed Mar. 29, 2007.

TECHNICAL FIELD

The present invention relates to leaching chambers for receiving and dispersing water and wastewater when buried in the soil, and more particularly, to such pre-molded leaching chambers as are corrugated and arch-shaped in cross-section with contiguously molded end walls, and lateral interior chambers having fluid communication openings at the chamber base.

BACKGROUND ART

The use of above-ground watering systems, particularly in dry climates such as the southwestern regions of the United States and in the Mediterranean regions of Europe, the Middle East, and Africa, brings with it a list of known problems. In addition to water loss through evaporation during the watering process, if watering is provided too lightly, shallow plant rooting results. Additionally, repeated surface applications of water tend to produce the buildup of mineral salts, which are detrimental to healthy plant growth.

As increasing population pressures result in greater demands upon fresh water supplies, the benefits of underground irrigation have become increasingly attractive. Such systems place water almost directly into the plant root zone and eliminate evaporative water losses. Their protected location also minimizes the risk of damage from surface activities.

The subsurface fluid distribution system described in my previous patent, Sipaila, U.S. Pat. No. 5,921,711, provides such a subterranean system with reserve fluid storage capacity to maintain soil dampness as well as replace water taken up by plants. As used in a passive subsurface irrigation system, capillary physics and gravity are relied upon to deliver water and nutrients to plants through an interconnected series of chambers and pans. Such systems are capable of reducing the amount of irrigation water required by 50-80% over the more traditional above-ground systems.

As is typical for such systems, the leaching chamber has sloped sidewalls that extend to a curved, arched top. When installed, such extended-arch chambers must resist both top and side loadings. The slots in the sidewalls permit the transport of water from within, but act to weaken the sidewall structure.

While thickening the sidewall would provide additional strength, it also results in an increase in the amount of material required—which is a polyolefin, and is thus tied to the rising cost of petrochemicals. In addition, the added weight of the resulting product adds to the cost of transporting the chambers to the installation site. Also, while it is vital that such chambers are able to efficiently stack for transport, the stacking of such bulked-up chamber walls must not result in forcing the sidewalls out, resulting in the overall flattening and weakening of the arch-shaped chamber.

It thus is desirable to provide additional solutions that increase the structural integrity of the arched chamber in a manner that enhances the operational efficiency and is not negated by increased transportation costs or product damage during shipment.

DISCLOSURE OF THE INVENTION

These and other objects are achieved by providing a pre-molded leaching chamber of arch-shaped cross-section, having a pair of contiguously molded, opposing end walls, alternating peak and valley corrugations along its length, and interior chambers formed at the base of the chamber at each peak corrugation providing fluid communication between the exterior and interior of the leaching chamber. The interior chambers are formed by an inner wall attached to an interior surface of the leaching chamber and extending substantially within the peak corrugation, spaced from the outer wall, to the base of the chamber. Vertically off-set apertures are formed in the inner wall and in the opposing outer wall, enabling fluid flow within the inner chamber.

A leaching chamber comprising: a corrugated outer shell extending along a longitudinal axis in a manner defining alternating peak corrugations and valley corrugations, said corrugated outer shell having an arch-shaped cross-section with a pair of opposed lateral end walls formed therein and no floor; and a plurality of inner walls attached to an interior wall of said corrugated outer shell, each at a location within a separate interior valley formed in said interior wall, with each of said interior valleys corresponding to a peak corrugation formed in said outer shell, said plurality of inner walls extending from a location of attachment to said interior wall to a terminus of a respective one of said interior valleys, each of said plurality of inner walls extending in a manner inwardly spaced from said corrugated outer shell to define a plurality of interior chambers, wherein each of the plurality of interior chambers has an inner wall aperture formed in said respective inner wall and an outer shell aperture formed in the corrugated outer shell.

A leaching chamber having an arch-shaped cross-section and alternating peak corrugations and valley corrugations along its length comprising: a pair of opposed end walls attached to said leaching chamber at opposite ends thereof, each of said pair of opposed end walls having a connecting pipe aperture formed therein; and a plurality of inner walls attached to an inner surface of said leaching chamber and extending towards a base of said leaching chamber, each of said plurality of inner walls extending in a spaced-apart manner from a separate one of such adjacent lateral wall segment of said leaching chamber as defines one of said alternating peak corrugations, each of said plurality of inner walls and each of said respective adjacent lateral wall segments define an individual interior chamber formed therebetween, each of said inner walls and said adjacent lateral wall segments have an aperture formed therein, whereby fluid communication between an interior of said leaching chamber and an outer environment of said leaching chamber may occur through each of said plurality of interior chambers.

These and various other advantages and features of the present invention are pointed out with particularity in the claims. Reference should also be had to the drawings which form a further part hereof, as well as to the accompanying descriptive matter in which are illustrated and described in various examples of with the invention.

DETAILED DESCRIPTION OF THE PREFERRED EMBODIMENTS

Figure 1:
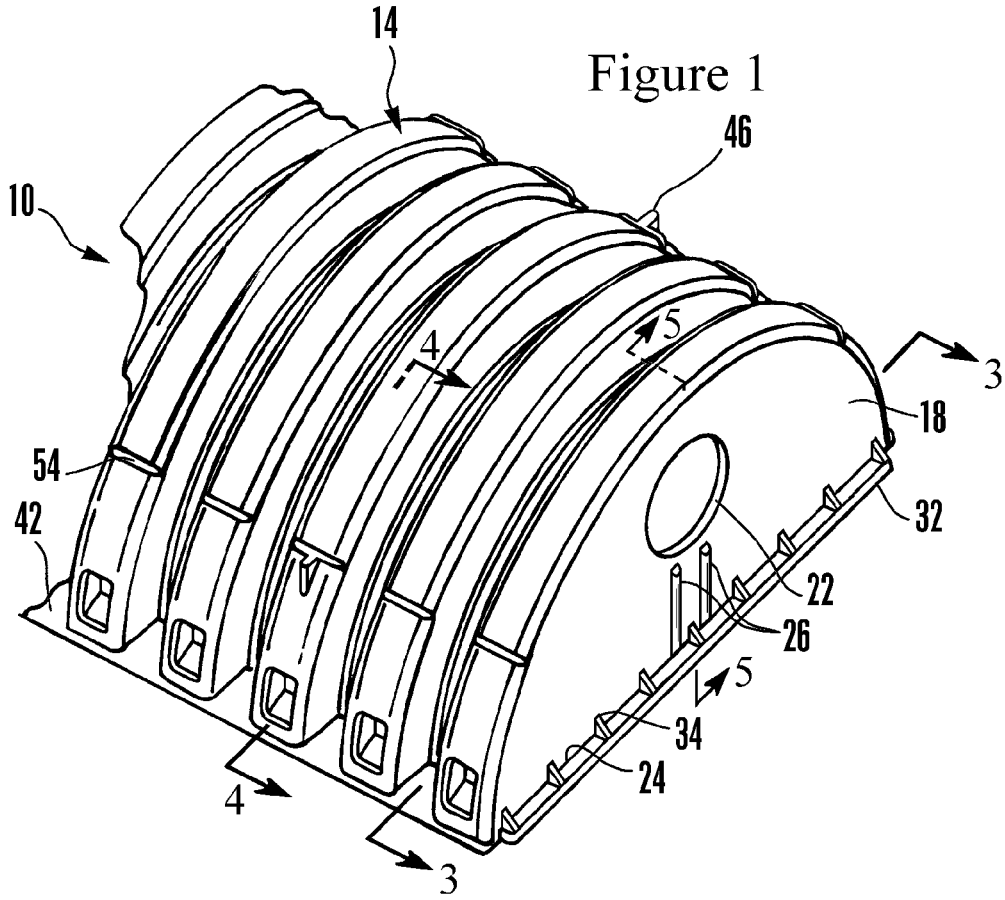
FIG. 1 is a partial top perspective view of a leaching chamber in accordance with the present invention.

Reference is now made to the drawings wherein like numerals refer to like parts throughout. In FIG. 1, a leaching chamber 10 includes a corrugated outer shell 14 and an end wall 18. A connecting pipe aperture 22 is centrally located in the end wall 18, and is appropriately sized to receive a connector pipe that extends between and is used to connect adjacent leaching chambers (not shown in the Figures).

Figure 3:
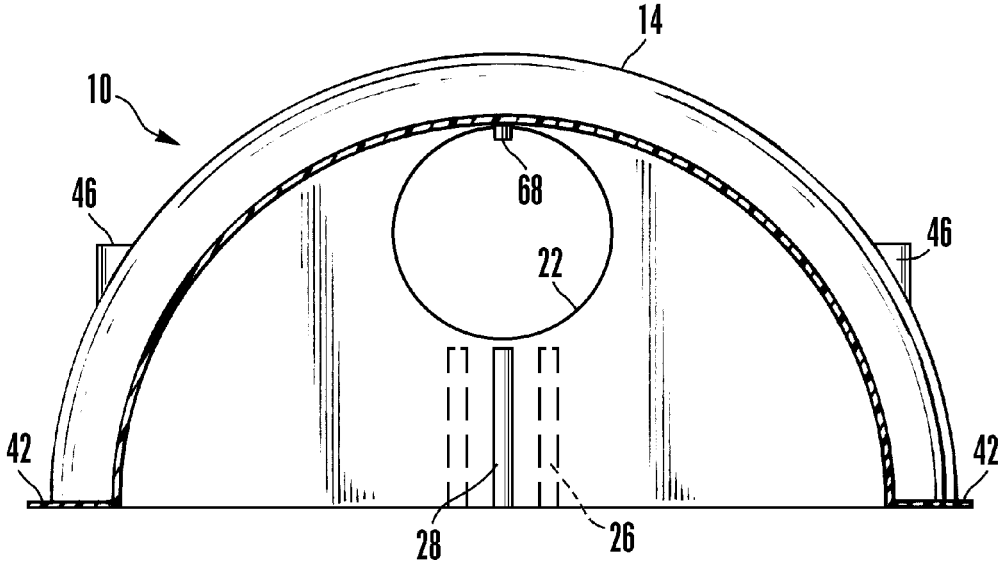
FIG. 3 is a cross-sectional view, with portions shown in phantom, taken along line 3-3 of FIG. 1.

The end wall 18 also includes a pair of outer fluting extrusions 26 that are centrally located and extend between the connecting pipe aperture 22 and a base 24 of the end wall 18. Functioning as stiffeners, the outer fluting extrusions 26, together with a single inner fluting extrusion 28 (see FIG. 3), provide three-dimensional structural support to the end wall 18 without compromising the extrusion process of fabricating the leaching chamber 10.

Additional structural support is provided by a footing flange 32 that is attached to and extends from the base 24 of the end wall 18. A plurality of triangular braces 34 are arranged in a spaced-apart manner along the footing flange 32 to provide lateral rigidity to the flat end wall 18. Each of these end wall reinforcement features may be fabricated as part of the extrusion process used to form the end wall and corrugated outer shell of the leaching chamber 10.

Figure 6:
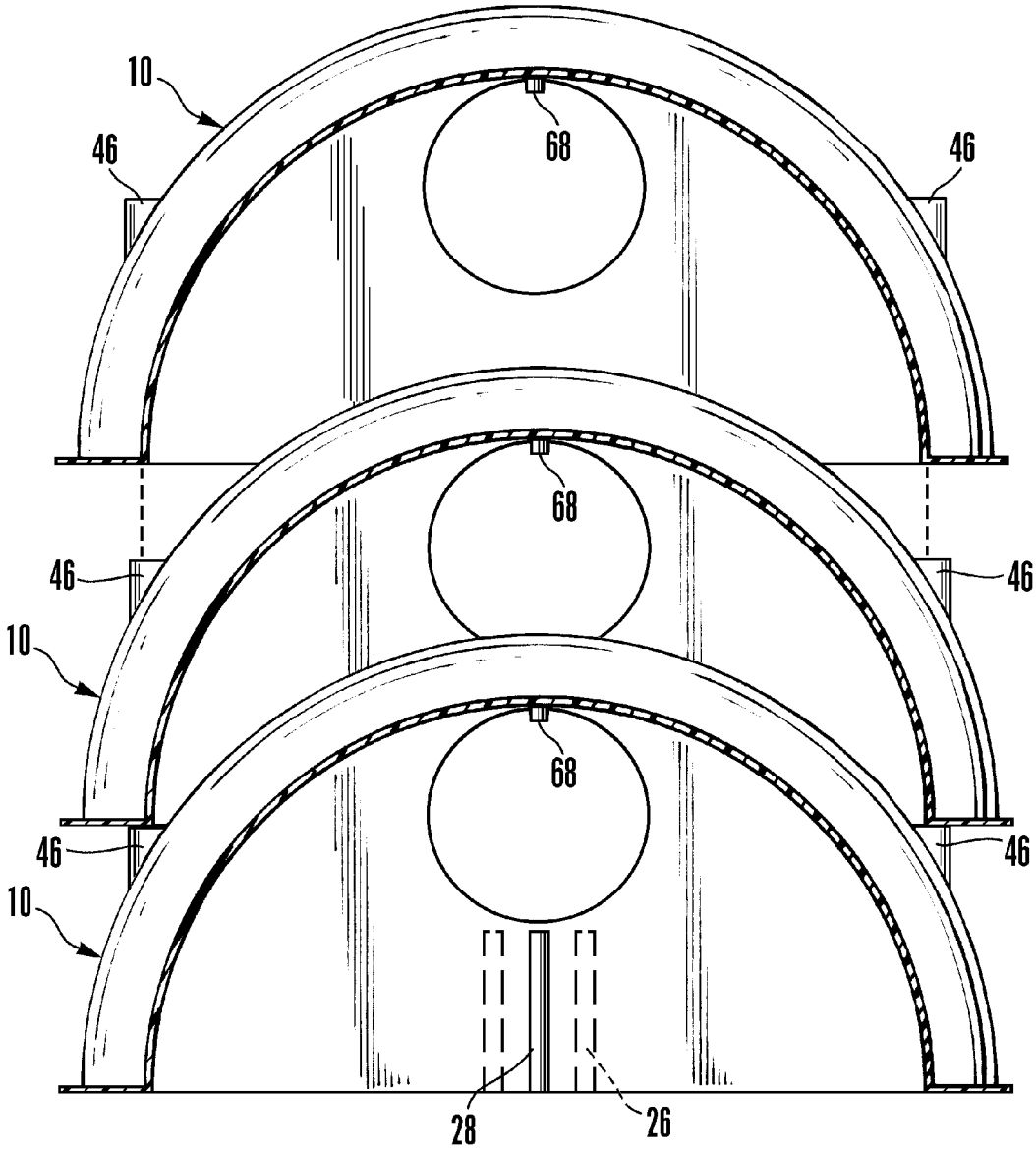
FIG. 6 is a partially exploded cross-sectional view of a plurality of stacked leaching chambers, the cross-sectional views of each of the chambers taken along line 3-3 of FIG. 1.

A support footing 42 extends along each lateral terminus of the corrugated outer shell 14, providing a stable support base when the leaching chamber 10 is positioned for use in an irrigation system or drainage system as well as when it is stacked for transport. In regard to the latter function, a stacking nub 46 is formed on and projects at a lateral location on the corrugated outer shell 14. The stacking nubs 46 are positioned in a manner that provides support to the support footing 42 when a plurality of leaching chambers 10 are vertically stacked (see FIGS. 3 and 6).

Figure 2:
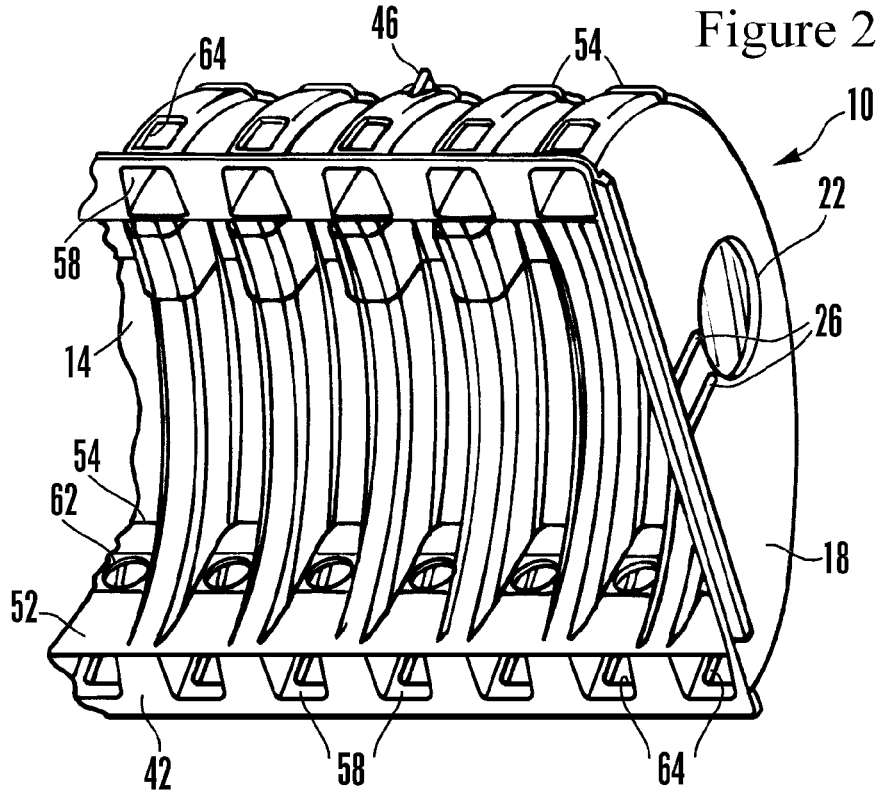
FIG. 2 is a partial bottom perspective view of the leach chamber of FIG. 1.

The corrugated outer shell 14 exhibits a repeating outer pattern of peak corrugations and valley corrugations (ridges and grooves), with these outer peaks and valleys inversely corresponding to peaks and valleys from a perspective within the leaching chamber 10 (see FIG. 2). An inner wall 52 is formed within each of the interior valleys, and extends from the support footing 42 to a fused attachment seam 54 formed in the corrugated outer shell 14.

Figure 4:
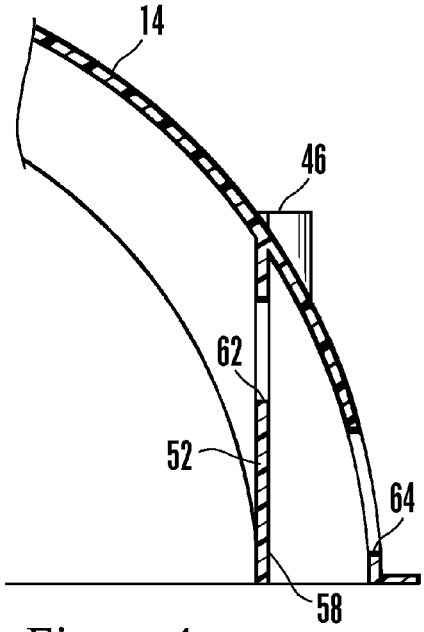
FIG. 4 is a partial cross-sectional view taken along line 4-4 of FIG. 1.

The inner wall is inwardly spaced from the corrugated outer shell 14 at its location of attachment to the support footing 42, forming an interior chamber 58 (see FIG. 4). A plurality of such interior chambers 58 are formed in, and laterally extend along, in a spaced-apart manner, both longitudinal sides of the leaching chamber 10. Each of the interior chambers 58 is provided an inner wall aperture 62 formed in the inner wall 52 and an outer shell aperture 64 that is formed in the corrugated outer shell 14.

In a presently preferred embodiment, the inner wall aperture 62 and the outer shell aperture 64 are vertically off-set, with the outer shell aperture 64 at a vertical location that is lower than the inner wall aperture 62 when the leaching chamber 10 is in operation. As is best shown in FIG. 4, this vertical off-set inhibits the reverse flow of particulate matter from the outer environment through the interior chamber 58, which would otherwise result in the fouling of the primary chamber of the leaching chamber 10.

As discussed previously, most applications require a series of leaching chambers 10 that are connected together using discrete connecting pipes, with each pipe extending between opposing connecting pipe apertures to connect together adjoining leaching chambers 10. It is essential that each leaching chamber 10 remain in fluid communication with any adjoining leaching chamber 10 with which it shares a connecting pipe 70 (see FIG. 7).

Figure 5:
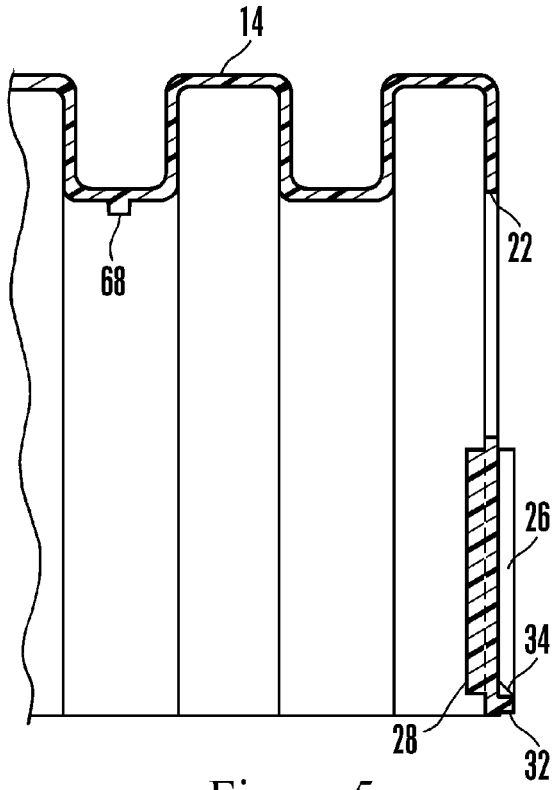
FIG. 5 is a partial cross-sectional view taken along line 5-5 of FIG. 1.
Figure 7:
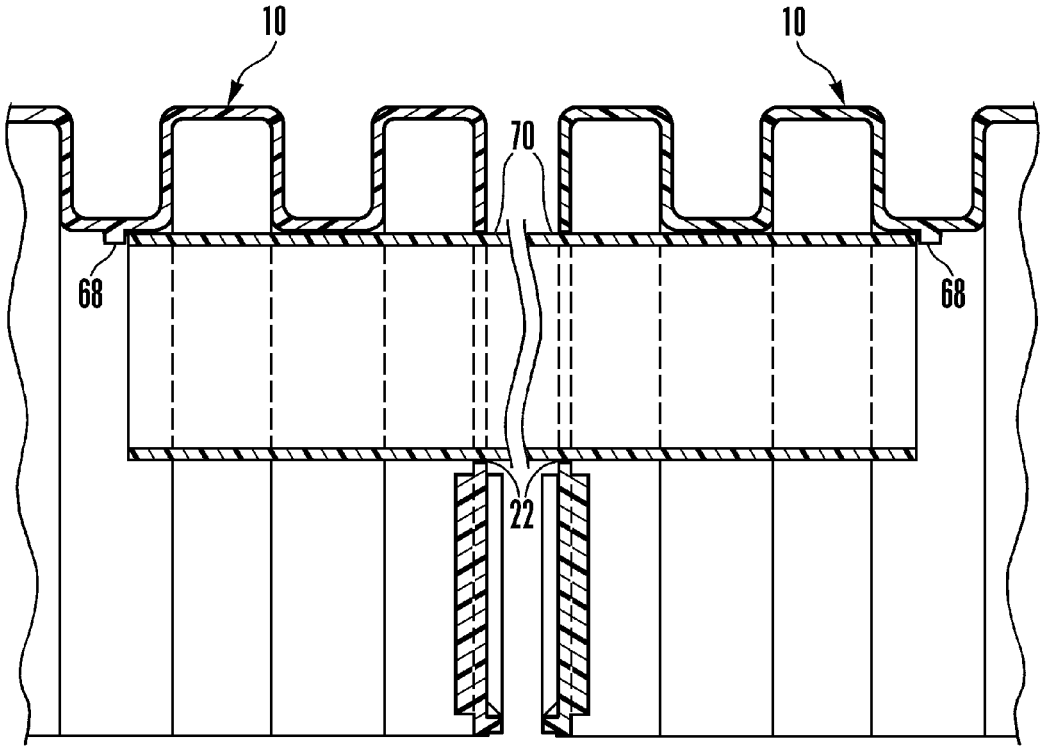
FIG. 7 is a partial cross-sectional view showing a connecting pipe enabling fluid communication between an adjacent pair of leaching chambers.

As is depicted in both FIGS. 5 and 7, a stop nub 68 is formed in an interior wall of the corrugated outer shell 14 and extends downwardly to provide a surface against which an end of the connecting pipe 70 can rest. The stop nub 68 resists any further inward migration of the connecting pipe 70 after installation. Such longitudinal movement—in either direction, could result in the dislodgement of the connecting pipe 70 from an adjoining leaching chamber 10, which in turn would abruptly end or severely impair the fluid communication therebetween. The distance between the adjacent, connected leaching chambers 10 can be as short as a few inches or as long as ten feet, depending upon the particular application. Separation in typical athletic fields is about one foot between the end walls 18.

Figure 8:
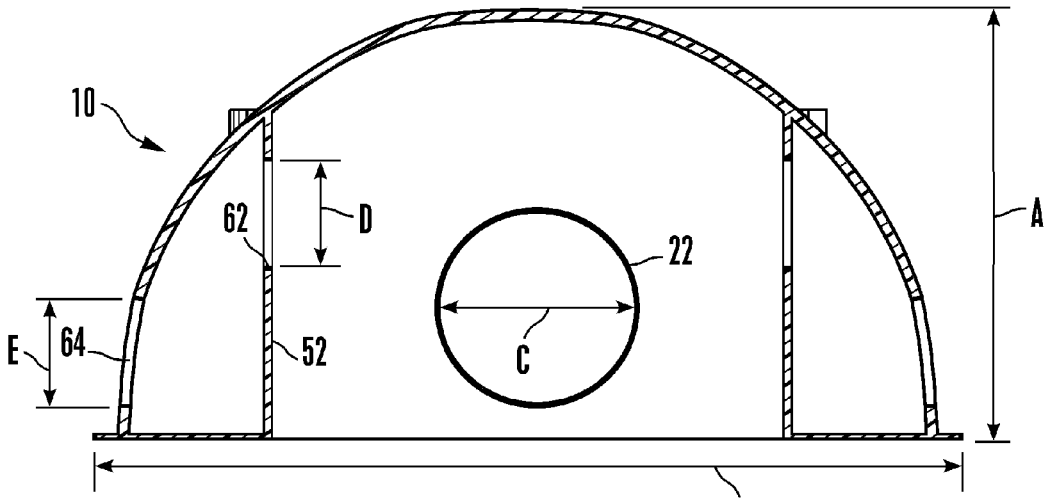
FIG. 8 is a cross-sectional view, similar to FIG. 3, with portions shown in phantom, taken along line 3-3 of FIG. 1 showing an alternative embodiment of the present invention.

In an alternative embodiment of the present invention shown in FIG. 8, the connecting pipe aperture 22 has been repositioned close to the base 24 of the end wall 18. Under this embodiment drainage occurs at the bottom of the leaching chamber 10, and no or only a very slight amount of water remains within the leaching chamber 10—unlike the reservoir of water created within the leaching chamber 10 when the connecting pipe aperture 22 is positioned at a higher location on the end wall 18 (see FIG. 3).

The embodiment of FIG. 8 is also provided a lower profile, having a preferred height A of 4 inches instead of 6.3 inches, and a width B of 8.25 inches instead of the previous 13.25 inches. These dimensions provide a reduced profile having less cost in material, the ability to be placed at a shallower depth and with less fill—both lowering installation costs. The remaining dimensions are preferably much the same as in the previously discussed embodiment, the connecting pipe aperture 22 having a diameter C of 2.375 inches, the inner wall aperture 62 having a height D of 0.875 inches, and the outer shell aperture 64 having a height E of 1 inch (preferably reduced by one-half inch as compared to the previously-discussed embodiment).

The embodiment shown in FIG. 8 is best suited for applications in which drainage is the primary and/or only intended function. However, in flat arrays of the system, water backup can be obtained by utilizing an up-turned elbow as a terminating connecting pipe (not shown in the Figures). Such a terminus would create a pressure head, resulting in the flooding of the connector pipe and all intermediate leaching chambers—making irrigation a possible, but not preferred function of the alternative embodiment shown in FIG. 8.

In a presently preferred embodiment, and recognizing that other dimensions are possible—and considered within the scope of the present invention, the leaching chamber 10 is fabricated by extruding a plastic such as high density polyethylene, polypropylene or other suitable polymers. By positioning all of the offset and connecting apertures in an injection mold cavity, all of the improvements can be monolithically molded to produce a one-piece leaching chamber without any other machining. The inner wall apertures and the outer shell apertures are spaced approximately one-and-a-half inches apart, on center, and are vertically offset approximately 1 to 1½ inches. The ½ inch stacking nub 46 and ¼ diameter and ½ inch-long stop nub 68; the ¼ inch by 3 inch-long fluting extrusions, the 2 inch height of the inner wall 52; the 1 inch width of the footing flange 32, the ½ inch triangular braces 34, and the 1 inch wide support footing 42 can all be incorporated in the same injection mold process to produce a single piece integrated chamber.

The installation of the leaching chambers in accordance with the present invention is initiated by the excavation of a series of trenches, fourteen to eighteen inches deep and eighteen to forty-eight inches wide. The length and width of the trenches will vary, depending upon the design requirements for the particular leaching bed, irrigation field or drainage tile. At a minimum, an excavated section of length four feet is leveled, and if downward leaching of water is not desired, water impermeable liners or enclosing boxes are installed in the leveled trench. Thereafter a series of leaching chambers are placed within the trench, and laid end-to-end so that the lateral leaching chamber water discharge apertures are substantially aligned. The leaching chambers are then connected to one another utilizing the end panel connector pipes.

A layer of sand or suitable fine gravel for drainage applications is then back-filled over the leaching chambers. Since the upward capillary draw of most sands exceeds a ten-inch vertical above the waterline, a preferred depth of the fill sand over the leaching chambers is approximately twelve inches from the trench bed. The present invention can make use of sands of varying coarseness, with a sand coarseness of 0.3 mm to 0.6 mm grain size being viewed as particularly appropriate.

Finally, the sand layer may be optionally covered with top soil to a depth of between approximately zero to four inches. Because of the arched cross-section of the outer shell 24, the leaching chambers 10 are sufficiently strong to withstand the weight of vehicles on top of the replaced soil. Additionally, the individual settling of the leaching chambers within the trenches will not cause a break in the sand seal of the system, since the connector pipes 70 are self-adjusting with the apertures 22 in the end wall 18.

Depending upon the slope of the particular terrain, several different arrangements of the leaching chamber arrays are possible. Since the leaching chamber units act independently throughout their (preferred) four foot length, on sloping terrain the trenches are preferably excavated level along the slope contours. The "adjacent" leaching chambers can then be connected perpendicularly across the slope contours, with such adjacent leaching chambers located on different vertical levels, utilizing longer connector pipes where required.

My invention has been disclosed in terms of a preferred embodiment thereof, which provides an improved half-pipe leaching chambers for subterranean fluid distribution that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A leaching chamber comprising:

a corrugated outer shell extending along a longitudinal axis in a manner defining alternating peak corrugations and valley corrugations, said corrugated outer shell having an arch-shaped cross-section with a pair of opposed lateral end walls formed therein and no floor; and a plurality of inner walls attached to an interior wall of said corrugated outer shell, each at a location within a separate interior valley formed in said interior wall, with each of said interior valleys corresponding to a peak corrugation formed in said outer shell, said plurality of inner walls extending from a location of attachment to said interior wall to a terminus of a respective one of said interior valleys, each of said plurality of inner walls extending in a manner inwardly spaced from said corrugated outer shell to define a plurality of interior chambers, wherein each of the plurality of interior chambers has an inner wall aperture formed in said respective inner wall and an outer shell aperture formed in the corrugated outer shell.

2. A leaching chamber according to claim 1, wherein the inner wall aperture and the outer shell aperture are vertically off-set.

3. A leaching chamber according to claim 2, wherein the outer shell aperture is at a vertical location that is lower than the inner wall aperture.

4. A leaching chamber according to claim 3, and further comprising a support footing attached to and extending from said corrugated outer shell along each longitudinal terminus thereof.

5. A leaching chamber according to claim 4, and further comprising a footing flange attached to and extending from a base of each of said pair of opposed lateral end walls.

6. A leaching chamber according to claim 5, and further comprising a plurality of stacking nubs formed on and projecting outwardly from said corrugated outer shell at a plurality of lateral, spaced-apart locations.

7. A leaching chamber according to claim 6, wherein said plurality of stacking nubs comprise at least a single linear arrangement substantially parallel to said longitudinal axis of said corrugated outer shell.

8. A leaching chamber according to claim 7, wherein said plurality of stacking nubs comprise a pair of linear arrangements parallel to and symmetrically positioned on each side of said longitudinal axis of said corrugated outer shell, whereby said plurality of stacking nubs provide support to said support footings when a plurality of leaching chambers are vertically stacked.

9. A leaching chamber according to claim 8, wherein said pair of opposed lateral end walls each comprise a contiguously molded structure to said corrugated outer shell, each of said end walls having a connecting pipe aperture centrally formed therein.

10. A leaching chamber according to claim 9, and further comprising at least one fluting extrusion formed on a surface of each of said pair of opposed lateral end walls, said at least one fluting extrusion centrally located and extending between the connecting pipe aperture and the base of the lateral end wall.

11. A leaching chamber according to claim 10, wherein each of said pair of opposed lateral end walls is provided a pair of outer fluting extrusions formed on an outer surface of each of said opposed lateral end walls and a single inner fluting extrusion formed on an inner surface of each of said opposed lateral end walls.

12. A leaching chamber according to claim 10, and further comprising a stop nub formed in an interior wall of said corrugated outer shell and projecting downwardly therefrom, said stop nub cooperatively engaging with a connecting pipe when the latter is selectively received within an interior of said corrugated outer shell, said stop nub engaging with a terminus of said connecting pipe when the latter is received by and extends through said connecting pipe aperture in said lateral end wall, whereby the stop nub prevents the further intrusion of said connecting pipe within said interior of said corrugated outer shell.

13. A leaching chamber according to claim 12, wherein said stop nub is formed in said corrugated outer shell at an apex of said arch-shaped cross-section.

14. A leaching chamber having an arch-shaped cross-section and alternating peak corrugations and valley corrugations along its length comprising:

a pair of opposed end walls attached to said leaching chamber at opposite ends thereof, each of said pair of opposed end walls having a connecting pipe aperture formed therein; and a plurality of inner walls attached to an inner surface of said leaching chamber and extending towards a base of said leaching chamber, each of said plurality of inner walls extending in a spaced-apart manner from a separate one of such adjacent lateral wall segment of said leaching chamber as defines one of said alternating peak corrugations, each of said plurality of inner walls and each of said respective adjacent lateral wall segments define an individual interior chamber formed therebetween, each of said inner walls and said adjacent lateral wall segments have an aperture formed therein, whereby fluid communication between an interior of said leaching chamber and an outer environment of said leaching chamber may occur through each of said plurality of interior chambers.

15. The leaching chamber of claim 14, wherein each of the inner wall apertures and each respective one of the adjacent lateral wall apertures are vertically off-set.

16. The leaching chamber of claim 15, wherein the lateral aperture is at a vertical location that is lower than the inner wall aperture.

17. The leaching chamber of claim 16, and further comprising a footing flange formed on each terminus of the lateral walls of the leaching chamber.

18. The leaching chamber of claim 17, wherein said pair of opposed end walls each comprise a contiguously molded structure to said leaching chamber of said arch-shaped cross-section.

19. The leaching chamber of claim 18, and further comprising a footing flange formed in and extending from a base of each said pair of opposed end walls.

20. The leaching chamber of claim 19, and further comprising a plurality of stacking nubs formed on and projecting outwardly from an outer surface of said leaching chamber at a plurality of spaced-apart locations along its length.

* * * * *